US009596534B2

(12) United States Patent
Heiman et al.

(10) Patent No.: US 9,596,534 B2
(45) Date of Patent: Mar. 14, 2017

(54) EQUALIZATION AND POWER CONTROL OF BONE CONDUCTION ELEMENTS

(71) Applicant: DSP Group, San Jose, CA (US)

(72) Inventors: Arie Heiman, Sde Warburg (IL); Moshe Haiut, Ramat Gan (IL); Uri Yehuday, Bat-Yam (IL)

(73) Assignee: DSP Group Ltd., Herzliya (IL)

( * ) Notice: Subject to any disclaimer, the term of this patent is extended or adjusted under 35 U.S.C. 154(b) by 0 days.

(21) Appl. No.: 14/143,282

(22) Filed: Dec. 30, 2013

(65) Prior Publication Data

US 2014/0363033 A1 Dec. 11, 2014

Related U.S. Application Data

(60) Provisional application No. 61/833,461, filed on Jun. 11, 2013.

(51) Int. Cl.

| | |
|---|---|
| ***H04R 1/46*** | (2006.01) |
| *H04R 25/00* | (2006.01) |
| *H04R 3/02* | (2006.01) |

(52) U.S. Cl.

CPC ..... *H04R 1/46* (2013.01); *H04R 3/02* (2013.01); *H04R 25/407* (2013.01); *H04R 25/45* (2013.01); *H04R 25/453* (2013.01); *H04R 25/505* (2013.01); *H04R 25/606* (2013.01); *H04R 2460/03* (2013.01); *H04R 2460/13* (2013.01)

(58) Field of Classification Search

CPC .... H04R 2460/13; H04R 1/46; H04R 25/606; H04R 25/45; H04R 25/407; H04R 2460/03; H04R 25/453; H04R 3/02; H04R 25/505

USPC ..... 381/151; 600/25; 330/123, 127–130

See application file for complete search history.

(56) References Cited

U.S. PATENT DOCUMENTS

| | | | | |
|---|---|---|---|---|
| 6,173,058 | B1 * | 1/2001 | Takada | 381/66 |
| 7,302,071 | B2 * | 11/2007 | Schumaier | H04R 25/606 381/151 |
| 8,154,345 | B2 * | 4/2012 | Andrys et al. | 330/298 |
| 8,325,964 | B2 * | 12/2012 | Weisman | H04R 1/1083 381/151 |
| 8,858,420 | B2 * | 10/2014 | Elofsson | 600/25 |
| 8,995,502 | B1 * | 3/2015 | Lai | H04L 25/00 375/219 |
| 2003/0214355 | A1 * | 11/2003 | Luz | H03F 3/24 330/124 R |
| 2004/0037428 | A1 * | 2/2004 | Keller | A61B 5/121 381/60 |

(Continued)

*Primary Examiner* — Davetta W Goins
*Assistant Examiner* — Oyesola C Ojo
(74) *Attorney, Agent, or Firm* — Reches Patents

(57) ABSTRACT

Methods and systems are provided for controlling bone conduction, in which a bone conduction element may be used to output acoustic signals when it is in contact with a user. A bone conduction sensor may also be made in contact with the user, and used to obtain feedback relating to the outputting of the acoustic signals via the bone conduction element. The outputting of the acoustic signals may then be adaptively controlled based on processing of the feedback. The adaptive controlling may comprise adjusting components and/or functions related to or used in the outputting of the acoustic signals. For example, the adaptive controlling may comprise adjusting gain, frequency response, and/or equalization associated with a drive amplifier driving the bone conduction element.

22 Claims, 5 Drawing Sheets

(56) References Cited

U.S. PATENT DOCUMENTS

| | | | | |
|---|---|---|---|---|
| 2009/0220114 | A1* | 9/2009 | Wilson | 381/317 |
| 2011/0293105 | A1* | 12/2011 | Arie | H04M 1/05 381/71.11 |
| 2011/0301404 | A1* | 12/2011 | Bern | 600/25 |
| 2012/0288107 | A1* | 11/2012 | Lamm | H04R 25/30 381/59 |
| 2013/0156202 | A1* | 6/2013 | Hamacher | H04R 25/453 381/23.1 |

* cited by examiner

240

EQUALIZATION AND POWER CONTROL OF BONE CONDUCTION ELEMENTS

CLAIM OF PRIORITY

This patent application makes reference to, claims priority to and claims benefit from the U.S. Provisional Patent Application No. 61/833,461, filed on Jun. 11, 2013, which is hereby incorporated herein by reference in its entirety.

TECHNICAL FIELD

Aspects of the present application relate to electronic devices and audio processing. More specifically, certain implementations of the present disclosure relate to equalization and power control of bone conduction elements.

BACKGROUND

Existing methods and systems for controlling power and equalization in bone conduction elements may be inefficient. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

A system and/or method is provided for equalization and power control of bone conduction elements, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

Certain example implementations may be found in method and system for equalization and power control of bone conduction elements in electronic devices, particularly in handheld or otherwise user-supported devices. As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first plurality of lines of code and may comprise a second "circuit" when executing a second plurality of lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and "module" refer to functions than can be performed by one or more circuits. As utilized herein, the term "example" means serving as a non-limiting example, instance, or illustration. As utilized herein, the terms "for example" and "e.g.," introduce a list of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Figure 1:
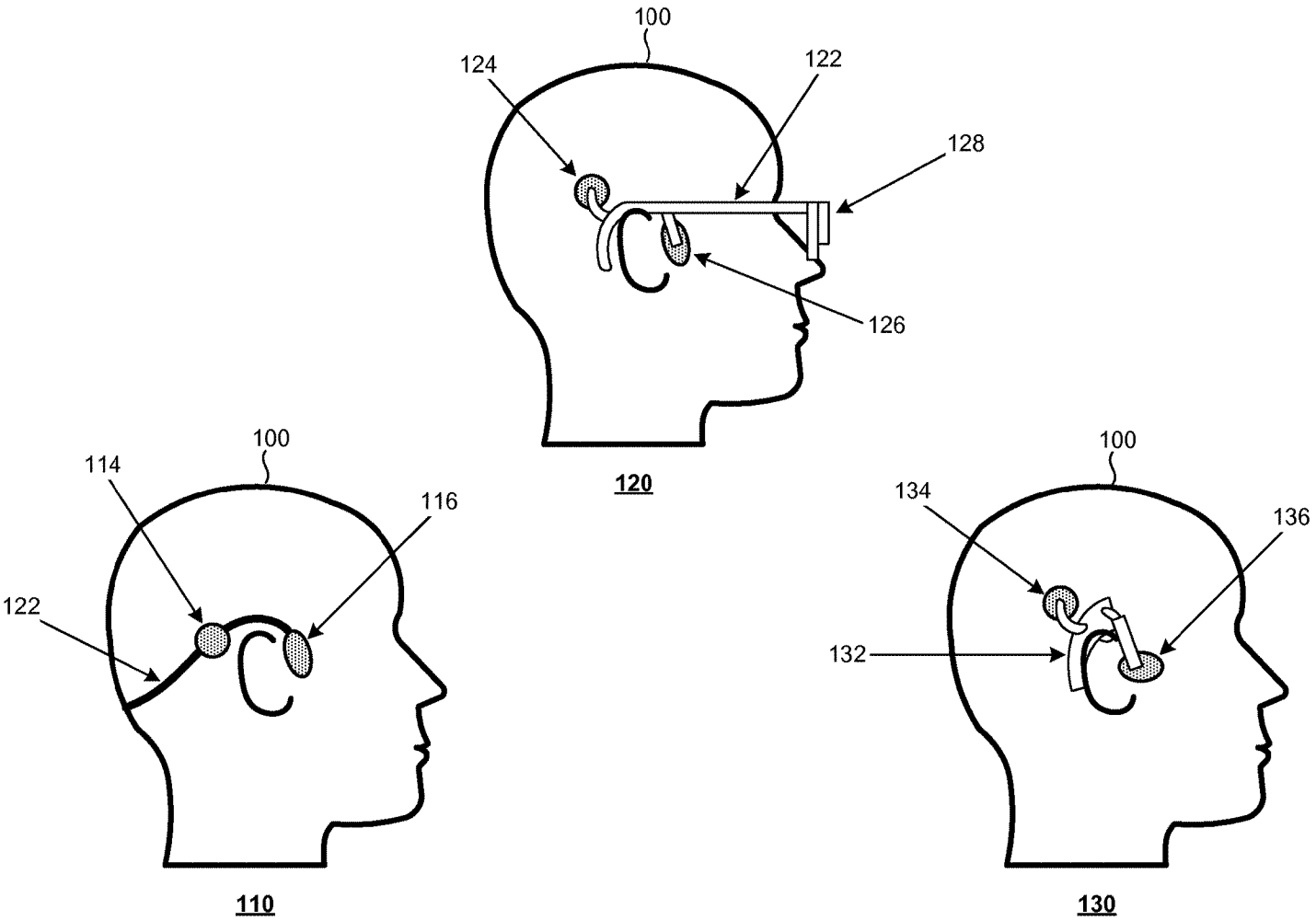
FIG. 1 illustrates examples of arrangements that incorporate bone conduction elements.

FIG. 1 illustrates examples of arrangements that incorporate bone conduction elements. Shown in FIG. 1 are different bone conduction arrangements 110, 120, and 130, which may be utilized to provide bond conduction operations with respect to a user 100.

In each of the bone conduction arrangements 110, 120, and 130, one or more bone conduction elements may be placed in contact with a user 100, to enable bone conduction operations with respect to a user 100. In this regard, bone conduction may be used in injecting acoustic signals directly through skull bones, to be captured by internal parts of a user's ears (thus bypassing the eardrums). For example, a bone conduction device may be a special earphone or headphone containing a bone conduction element (transducer), which may be contact with the skull bone(s). The contact may be made in particular location, which may provide optimal performance. For example, contact may usually be made behind the ear or in front of the ear, touching the skull. Bone conduction transducers may be driven by relatively high power audio amplifiers, in order to set up sufficient bone vibrations. While bone conduction devices are often provided to people with special needs (e.g., hearing disabilities), these devices may also be used in lieu of (or in addition to) typical speakers—e.g., a replacement for regular earphones where it is important not to block a user's hearing with respect to the surrounding sounds, such as when a user may need to be aware of his/her surroundings. For example, if a user is walking or running on or adjacent to a street, the user may need to be aware of surrounding sounds, such as traffic. Accordingly, blocking of environmental sounds may be dangerous, as it may make the user less aware of possible safety risks. Using bone conduction devices, however, would leave the eardrums open, thus allowing the user to be aware of the surroundings.

Bone conduction devices (and/or elements) may be used as, for example, stand-alone devices, for example as earpieces coupled with communication devices (e.g., a Bluetooth earpiece for use with mobile devices), and/or as components in wearable devices (e.g., Google Glass). For example, the bone conduction arrangement 110 may comprise a bone conduction headset 112 which the user 110 may wear, comprising bone conduction elements 114 and 116. The bone conduction element 116 may usually be situated just in front of the user's ear, and be coupled to the skull, whereas the bone conduction element 114 may be located above and behind the ear. The bone conduction arrangement 120 may comprise a wearable computer device 122 (e.g., Google Glass or the like), with a head mounted display 128. The wearable computer device 122 may comprise two bone conduction elements 124 and 126, connected to the device part resting on a user's ear. The bone conduction element 124 may be located above and behind the ear (and making contact with the skull); whereas the bone conduction element 126 may be located in front of the ear. The bone conduction arrangement 130 may comprise a bone conduction earpiece 132 (e.g., Bluetooth earpiece or the like), which the user 110 may wear over his/her ear. The bone conduction earpiece 132 may comprise two bone conduction elements 134 and 136, connected to the earpiece 132. The bone conduction element 134 may be integrated into main body of the earpiece 132, behind and above the ear, whereas the bone conduction element 136 may be connected to the earpiece 132 such that it may be placed in front of the ear. Nonetheless, it should be understood that the bone conduction arrangements 110, 120, and 130 are only provided as examples, and the disclosure is not limited to these arrangements.

In a bone conduction headphone, headset or earpiece, the audio signal is applied to one or more bone conduction elements by one or more audio driver amplifiers. It is problematic to determine the optimum driver amplitude and its desired frequency response as there is no immediate feedback to the driver control system, and the user will need to adjust and set the volume and/or the desired equalization of the speech signal. The optimum output level and the frequency response of the bone conductance strongly depends on the coupling quality of the bone conductive element to the bone, which can change over time, and from time to time. For example, each time the device is re-attached, or while the user is jogging or running, which causes the device to move, the volume may vary as the connection varies. Aspects of the present invention enable controlling the power and the equalization that is applied to the bone conductive element by observing the feedback from a second bone conduction device acting as a bone conduction sensor. In this manner, a separate bone conduction sensor is placed in contact with the user's skull. This sensor captures the bone vibrations that return from the acoustic injection and uses the resulting signal to adjust the equalization and or the level of the audio driver amplifier to the bone conduction element in a feedback circuit.

In some instances, it may be desirable to monitor (and control) bone conduction outputs. For example, in various bone conduction devices, the audio signals applied to the bone conduction elements may be driven by audio driver amplifiers. Thus, optimizing performance of such devices may entail determining optimal parameters for the driver amplifiers (e.g., optimum driver amplitude and/or desired frequency response). As mentioned above, determining such optimal parameters may be difficult or problematic, however, as there may be no immediate feedback to the driver control system, and the user may need to adjust and set the volume and/or the desired equalization of the speech signal. The optimum output level and the frequency response of the bone conductance may strongly depend on the coupling quality of the bone conductive element to the bone, which can change over time, and from time to time. For example, each time the bone conduction device is re-attached, or while the user is jogging or running, which causes the bone conduction device to move, the volume may vary as the connection varies. Accordingly, it may desirable to enable adaptive monitoring of bone conduction performance, and controlling based thereon of bone conduction functions and/or parameters (e.g., power and/or equalization applied to the bone conductive element). This may be achieved by utilizing bone conduction sensors (i.e., have one or more bone conduction elements be a sensor), to enable observing feedback—e.g., by capturing vibrations in the bones that return from the acoustic injection (by the bone conduction transducers). That feedback (and/or resulting signals based thereon) may then be used, such as using one or more feedback circuits, in controlling bone conduction output—e.g., in adjusting the equalization and or the level of the audio driver amplifiers to the bone conduction elements/transducers.

Accordingly, in each of the bone conduction arrangements 110, 120, and 130, one of the bone conduction elements may be configured as bone conduction transducer (i.e., for use in injecting the acoustic output) while another bone conduction element may be configured as bone conduction sensor, placed in contact with the user's skull (bones), for use in capturing bone vibrations returning from (or caused by) the acoustic injections. The captured signals may then be used (as feedback signals), such as via feedback circuits, in controlling the acoustic injections—e.g., in adjusting the equalization and or the level of the audio driver amplifier to the bone conduction element. For example, bone conduction elements 114, 124, and 134 may be the bone conduction transducers, whereas bone conduction elements 116, 126, and 136 may be the bone conduction sensors. The placement of the bone conduction transducers and sensors may be done in an adaptive manner, to ensure optimal performance (with respect to outputting and/or inputting). FIG. 1 shows example locations of bone conduction transducers and bone conduction sensors for arrangements 110, 120, and 130. Nonetheless, the positions of the bone conduction transducers and bone conduction sensors may be interchangeable. Further, in each arrangement, both the bone conduction transducer and the sensor may be mounted internally to the main device and/or adjacent to each other. Accordingly, vibrations resulting from the bone conduction transducers 114, 124, and 134 (when they are outputting acoustic signals) are transferred via the bones to the inner parts of the ear, bypassing the eardrum. Further, the bone conduction sensors 116, 126, and 136 may pick up the vibrations of the skull caused by the bone conduction transducers, and output voltage signals that may be used in one or more feedback circuits, to control the output (e.g., adjust the gain of the amplifier and/or equalization that is driving the bone conduction transducers).

Figure 2:
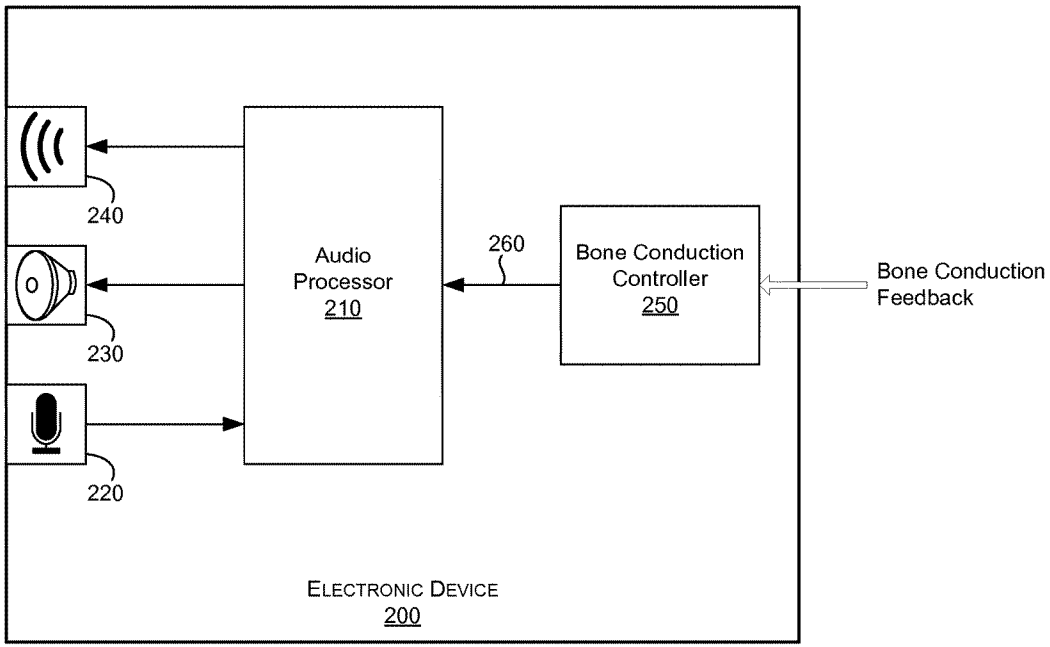
FIG. 2 illustrates an example electronic device that may support adaptive bone conduction operations.

FIG. 2 illustrates an example electronic device that may support adaptive bone conduction operations. Referring to FIG. 2, there is shown an electronic device 200.

The electronic device 200 may comprise suitable circuitry for performing or supporting various functions, operations, applications, and/or services. The functions, operations, applications, and/or services performed or supported by the electronic device 200 may be run or controlled based on user instructions and/or pre-configured instructions.

The electronic device 200 may be a stationary device (e.g., desktop computer). Alternatively, the electronic device 200 may be a mobile and/or user-supported device—i.e., intended to be supported (e.g., held or worn) by a user during use of the device, thus allowing for use of the device on the move and/or at different locations. In this regard, the electronic device 200 may be designed and/or configured to allow for ease of movement, such as to allow it to be readily moved while being supported by the user as the user moves, and the electronic device 200 may be configured to perform at least some of the operations, functions, applications and/or services supported by the device on the move.

Examples of electronic devices may comprise communication mobile devices (e.g., cellular phones, smartphones, and tablets), computers (e.g., servers, desktops, and laptops), dedicated media devices (e.g., televisions, portable media players, cameras, and game consoles), and the like. In some instances, the electronic device 200 may be a wearable device—i.e., may be worn by the device's user rather than being held in the user's hands. Examples of wearable electronic devices may comprise digital watches and watch-like devices (e.g., iWatch) and/or glasses-like devices (e.g., Google Glass). Nonetheless, the disclosure is not limited to any particular type of electronic device.

In some instances, the electronic device 200 may support input and/or output of audio. The electronic device 200 may incorporate, for example, a plurality of audio input and/or output (I/O) components (e.g., microphones, speakers, and/or other audio I/O components), for use in outputting (playing) and/or inputting (capturing) audio, along with suitable circuitry for driving, controlling and/or utilizing the audio I/O components.

For example, as shown in FIG. 1, the electronic device 200 may comprise an audio processor 210, a microphone 220, a speaker 230, and a bone conduction element 240. In this regard, the microphone 220 may be used in inputting (e.g., capturing) audio or other acoustic signals into the electronic device 200; whereas the speaker 230 and the bone conduction element 240 may be used in outputting audio (or other acoustic) signals from the electronic device 200. While speakers (e.g., the speaker 230) output audio by transmission of signals (e.g., via vibration of membranes) into the air, bone conduction elements (or bone conduction speakers) are used in outputting audio by injecting acoustic signals directly through the bones, such that the signals can be captured by the internal parts of the ear, bypassing the eardrum. To the extent that it is used in conjunction with bone conduction, the electronic device 200 may correspond to, for example, any of the devices (112, 122, and 132) of the bone conduction arrangements 110, 120, and 120 of FIG. 1.

The audio processor 210 may comprise suitable circuitry for performing various audio signal processing functions in the electronic device 200. The audio processor 210 may be operable to, for example, process audio signals captured via input audio components (e.g., the microphone 220), to enable converting them to electrical signals—e.g., for storage and/or communication external to the electronic device 200. The audio processor 210 may also be operable to process electrical signals to generate corresponding audio signals for output via output audio components (e.g., the speaker 230 and/or the bone conduction 240). The audio processor 210 may also comprise suitable circuitry operable or configurable to perform additional, audio related functions—e.g., voice coding/decoding operations. In this regard, the audio processor 210 may comprise analog-to-digital converters (ADCs), one or more digital-to-analog converters (DACs), and/or one or more multiplexers (MUXs), which may be used in directing signals handled in the audio processor 210 to appropriate input and output ports thereof. The audio processor 210 may comprise a general purpose processor, which may be configured to perform or support particular types of operations (e.g., audio related operations). Alternatively, the audio processor 210 may comprise a special purpose processor—e.g., a digital signal processor (DSP), a baseband processor, and/or an application processor (e.g., ASIC).

The bone conduction controller 250 may comprise suitable circuitry for controlling bone conduction related operations and/or functions in the electronic device 200. For example, the bone conduction controller 250 may support obtaining feedback corresponding to bone conduction based output (of acoustic signals) by the electronic device 200, processing of the feedback, and/or adjusting of functions and/or parameters relating to bone conduction outputting in the electronic device 200 (e.g., the bone conduction element 240 and/or the audio processor 210).

In operation, the electronic device 200 may be utilized in supporting input and/or output of audio (and other acoustic) signals. For example, when the electronic device 200 is used to input audio, audio signals may be captured via the microphone 220, and be processed in the audio processor 210—e.g., converting them into digital data, which may then be stored and/or communicated external to the electronic device 200. When the electronic device 200 is used to output audio, the electronic device 200 may receive (from other electronic devices) or read (e.g., from internal storage resources or suitable media storage devices) signals carrying audio content, process the signals to extract the data corresponding to the audio content, and then process the data via the audio processor 210 to convert them to audio signals. The audio signals may then be outputted via the speaker 230. In some instances, however, the audio signals may be outputted (in lieu of or in addition to a speaker) using bone conduction. In this regard, the output audio signals may be processed particularly via the audio processor 210 to make them suited for outputting via the bone conduction element 240.

In some instances, it may be desirable to provide dynamic, an adaptive monitoring and control mechanism of bone conduction by the electronic device 200. In this regard, as described in more detail with respect to FIG. 1, optimizing performance of bone conduction may entail determining optimal parameters for components used in bone conduction operations—e.g., determining optimum driver amplitude and/or desired frequency response when using driver amplifiers. Further, optimal parameters may change (and/or may need to be adjusted) continuously during use of the electronic device 200—e.g., being dependent on coupling quality of the bone conductive element to the bones, which may change over time, and from time to time. Accordingly, adaptive monitoring and/or control of bone conduction (e.g., via the bone conduction controller 250) may ensure that performance of bone conduction remains optimal. For example, the bone conduction controller 250 may incorporate or be coupled to sensory components (e.g., bone conduction sensors) which may be used in obtaining bone conduction feedback—e.g., by capturing vibrations in the bones that return from audio/acoustic injection (e.g., by the bone conduction element 240). In this regard, a separate bone conduction sensor (sometime also called bone conduction microphone) may be placed in contact with skull of a device's user, and used to detect the audio vibrations caused by the bone conduction element—e.g., bone vibrations that are returned by the acoustic injection. The bone conduction controller 250 may also incorporate circuitry for processing resulting feedback signals, such as to enable controlling bone conduction output—e.g., generating control signals 260, which may be used in adjusting audio processing and/or signal outputting parameters (e.g., equalization and/or the level of audio driver amplifiers used in bone conduction elements/transducers).

The use of bone conduction feedback (e.g., using suitable sensors and feedback circuits for processing of feedback signals obtained via the sensor), to monitor acoustic injection of bone conduction elements, may allow use of an automatic control scheme to balance the intensity or the equalization of bone conduction elements. By so doing, the user experience is enhanced and not subject to undue performance variations and the need to re-adjust the volume levels over time or each time the device is worn.

The bone conduction feedback may also be utilized for additional purposes. For example, detected signals from bone conduction sensors may be used (e.g., by the feedback circuit) to limit the level of the perceived sound to the user and hence prevent possible damage to the human ear due to excessive volume. Also, detected signals from bone conduction sensors may be used (e.g., by the feedback circuit) to limit excessive power consumption of component(s) used in bone conduction (e.g., audio driver amplifiers) and, in turn, optimize use of power supplies in electronic devices. Accordingly, use of an adaptive control scheme for bone conduction would result in automatic adjusting of the perceived volume to a persistently comfortable level, and the power consumption of the worn device can be optimized and the power supply (e.g., battery life) may be extended.

Bone conduction feedback may also be used to support enhanced user feedback. For example, where devices or bone conduction elements thereof are not well attached to the user's skull (and such, poor performance of bone conduction may not be compensated for by increasing the drive power), feedback may be generated and provided to the user by suitable means (audio, visual, etc.) to indicate the issue, and instruct the user to make necessary or desirable correction (e.g., adjust location or placement of bone conduction elements).

Figure 3:
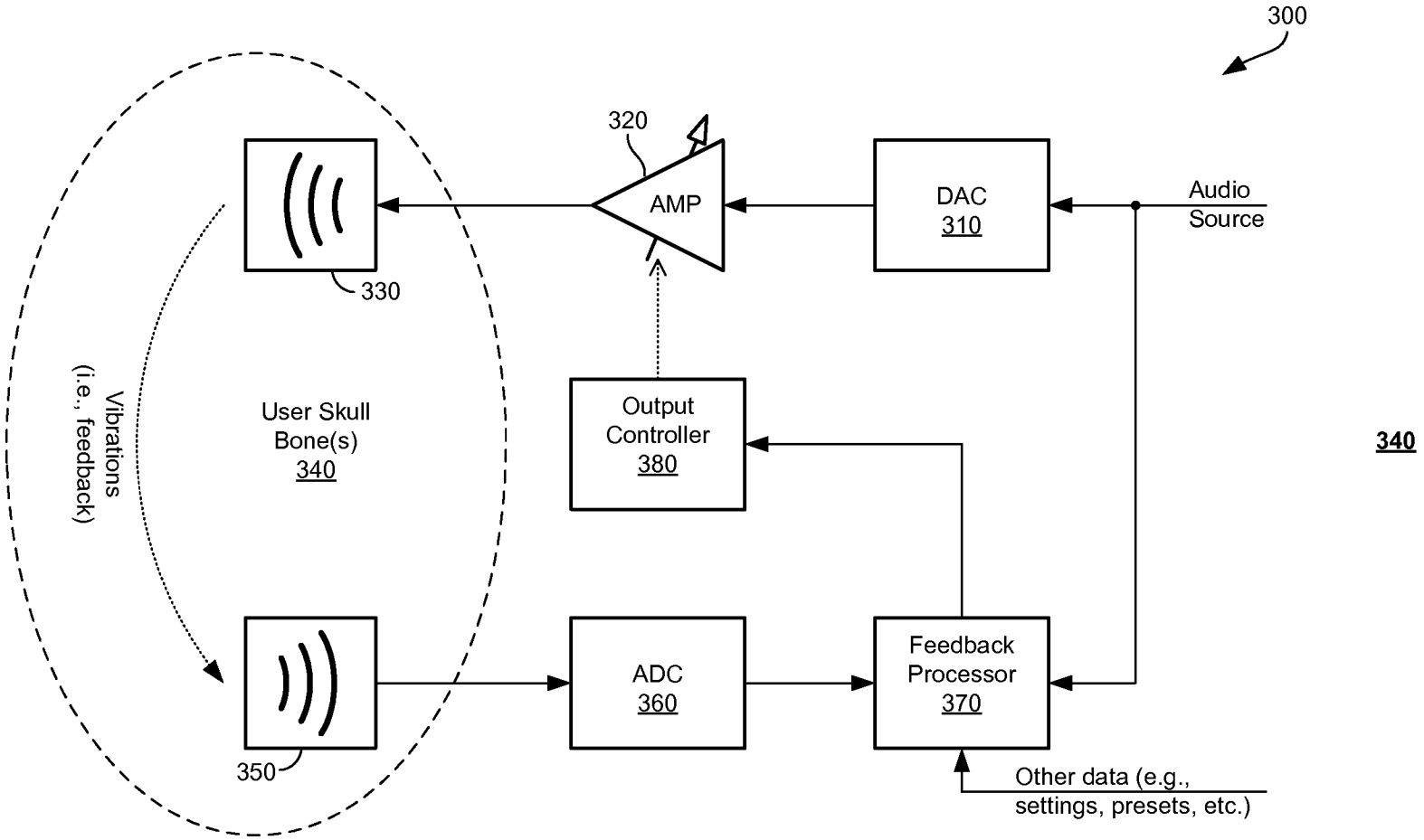
FIG. 3 illustrates an example system that may support equalization and power control of bone conduction elements.

FIG. 3 illustrates an example system that may support equalization and power control of bone conduction elements. Referring to FIG. 3, there is shown a system 300.

The system 300 may comprise suitable circuitry for outputting audio via bone conduction and/or for providing adaptive control thereof, particularly based on feedback. The feedback may be obtained based on sensory of vibration in the bones to which the audio output is applied, substantially as described with respect to FIG. 2 for example. Thus the system 300 may correspond to portions of the electronic device 200 that are utilized during bone conduction and/or bone conduction feedback (and control based thereon).

For example, as shown in FIG. 3, the system 300 may comprise a digital-to-analog convertor (DAC) 310, an amplifier 320, a bone conduction element 330, a bone conduction sensor 350, an analog-to-digital convertor (ADC) 360, a feedback processor 370, and an output controller 380. The amplifier 320 may be a variable equalizer and or gain amplifier.

The feedback processor 370 may comprise circuitry for processing feedback signals, such as to provide data that may be used for adaptive feedback based control of audio output operation in the system 300. The feedback processor 370 may be configured to analyze, for example, captured feedback signals, and/or may also analyze additional signals or parameters (e.g., the original signals, settings, etc.)

The output controller 380 may comprise circuitry for determining (and effectuating—e.g., via control signals) adjustments to audio output related operations or functions in the system 300. For example, the output controller 380 may be configured to determine gain and/or equalization adjustments that may be applied to the amplifier 320.

In operation, the system 300 may be utilized to provide audio output based on bone conduction and to track bone conduction feedback and use thereof (e.g., to provide adaptive feedback based control). For example, the system 300 may be configured to output, based on bone conduction, acoustics signals corresponding to an audio source signal. In this regard, an audio source signal may be typically be in digital form, and as such it would be first converted to an analog form by the DAC 310. The output of the DAC 310 may then be applied as input to the amplifier 320, the output of which may be used in driving the bone conduction element 330. The bone conduction element 330 may be coupled to a user's skull bones 340, and the vibrations from the bone conduction element 330 are transferred via the bone to the inner parts of the ear, bypassing the eardrum.

To provide bone conduction feedback and to facilitate adaptive control of bone conduction operations (injunction), the bone conduction sensor 350 may be also coupled to the user's skull bones 340, and hence may pick up the vibrations caused by the bone conduction element 330 via the skull bones 340. In response, the bone conduction sensor 350 may produce output feedback signals. The signal generated by the bone conduction sensor 350 may be, for example, an analog voltage, which may be inputted to ADC 360 for conversion to digital form (i.e., digital data). The output of the ADC 360, representing the feedback (digital) data, may then be processed by the feedback processor 370, to enable generating information that may be used in adjusting the output. In an example implementation, the feedback processor 370 may be configured to analyze feedback data by performing Discrete Fourier Transform (DFT) on data from the ADC 360, as well as data from the DAC 310, and then calculate the conductive transfer function and feedback signal average power. The output from the processing performed in the feedback processor 370 may be based on a comparison between the audio samples that were sent to the DAC 310 and the audio samples that were received from the ADC 360, and may have the form of a recommended gain-correction vector, which may specify the change in gain that is required per each frequency bin. The outcome of the processing by the feedback processor 370 may then be sent to output controller 380, which may utilize that data in determining if (and how) to adjust bone conduction outputting. For example, the output controller 380 may use the data provided by the feedback processor 370 to determining if/how to adjust the equalization and/or gain of the amplifier 320. For example, if the input to the output controller 380 indicates that the perceived volume of the user is too high, then the output controller 380 may reduce the gain of the amplifier 320 until the output from the comparison (in the feedback processor 370) changes. Similarly, if the input to the output controller 380 indicates that the perceived volume of the user is too low, then the output controller 380 may increase the gain of the amplifier 320 until the output from the comparator changes.

In some instances, standard hysteresis techniques may be used to prevent the amplification from constantly changing. For example, if the input to feedback processor 370 indicates that the perceived volume in specific frequencies bands are significantly different from the original audio source, the processor calculates the amount of compensation gain is needed and change the gain of the amplifier 3200.

In one implementation, the output of the ADC 360 may be compared, by the feedback processor 370, to (in lieu of or in addition to the original source signal) preset levels and/or levels that result from user setting—e.g., a user's volume control.

Accordingly, the system 300 may allow for setting and maintaining (via constant monitoring and adjusting) the volume of the output audio for the user at a preset comfortable level. Thus, the volume level may remain constant for changes over time or slight changes in positions of the worn device. The system 300 may also act to limit the audio volume such that no excessively high volume would be possible (thus protecting the hearing of the user). In addition, the system 300 may also protect against excessive audio drive power, which may damage the system (or any device incorporating the system). Further, with careful setting and/or use of feedback, power consumption in the system (or any device incorporating the system) may be reduced, thus improving and optimizing use of internal power sources (e.g., extending battery life). The volume control is based on spectral analysis of the feedback signal, as well as on its average power.

Figure 4:
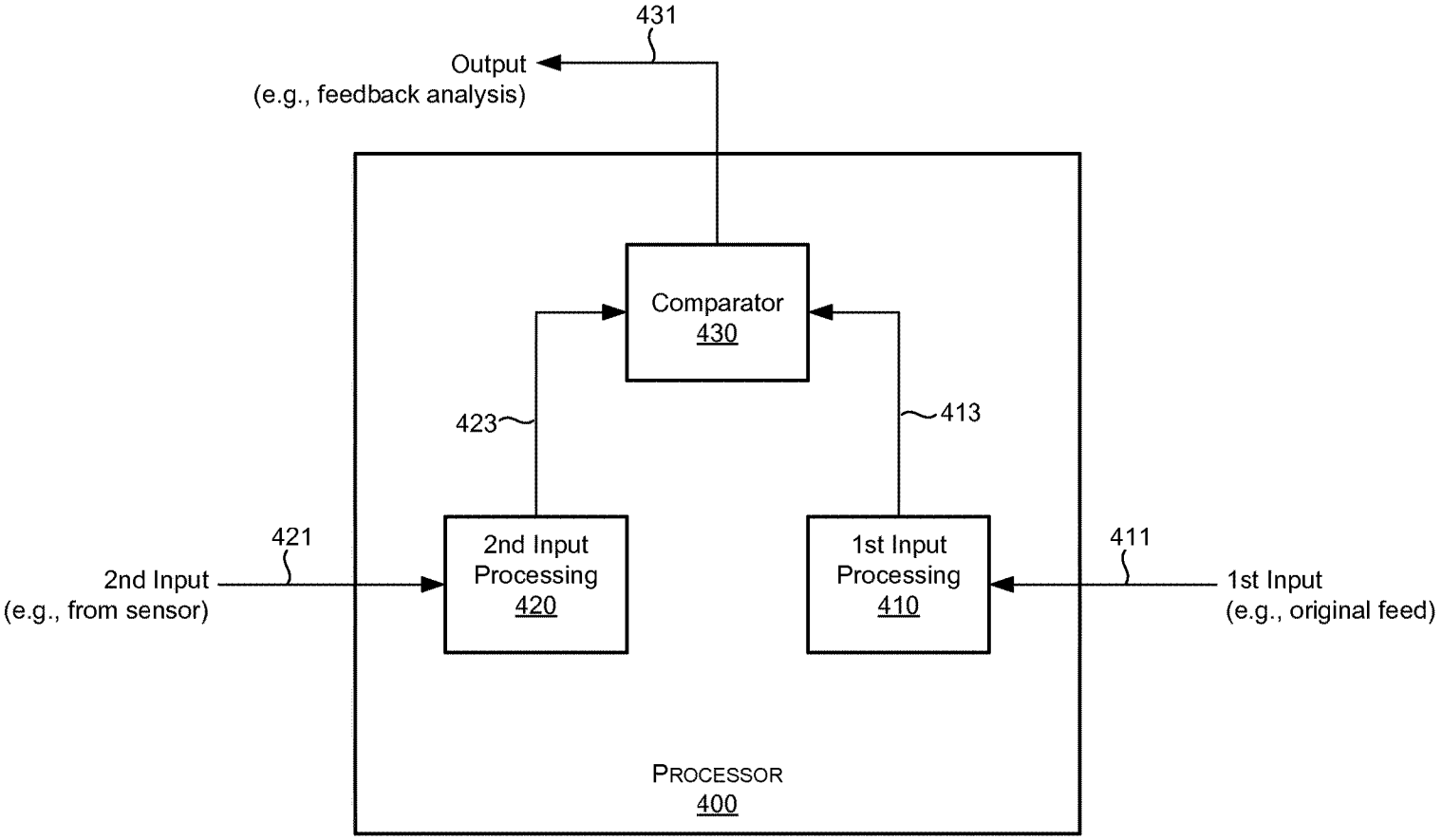
FIG. 4 illustrates an example feedback processor that may be used in processing feedback from bone conduction sensors.

FIG. 4 illustrates an example feedback processor that may be used in processing feedback from bone conduction sensors. Referring to FIG. 4, there is shown a feedback processor 400.

The feedback processor 400 may comprise suitable circuitry for processing one or more input signals. In particular, the processor 400 may be configured to provide feedback analysis corresponding to at least one of the input signals, such as where other input signal(s) represent feedback signals to the analyzed input signal(s). The feedback analysis performed by the processor 400 may, in some implementations, be based on other information—e.g., preconfigured parameters, user input, settings, etc. The feedback analysis done in the processor 400 may then be used to generate information which in turn may be utilized to provide adaptive control of the input signal(s), whose feedback is analyzed. The processor 400 may correspond to the feedback processor 370 of FIG. 3.

In the example implementation depicted in FIG. 4, in which the processor 400 may be configured to process two inputs, the processor 400 may comprise a first input processing block 410, a second input processing block 420, and a comparator 430. Each of the first input processing block 410 and the second input processing block 420 may comprise suitable circuitry for applying initial processing to two corresponding inputs (411 and 421, respectively), to enable generation of two corresponding intermediate outputs (413 and 423, respectively) which may be more suited for the analysis done in the processor 400. For example, each of the first input processing block 410 and the second input processing block 420 may be configured for performing discrete Fourier transforms (DFTs). In this regard, a DFTs may be used to convert equally spaced samples (of a particular function) into coefficients of a combination of complex sinusoids, ordered by their frequencies—i.e., convert a sampled function from its original domain (e.g., time domain) to the frequency domain. The comparator 430 may comprise suitable circuitry for comparing intermediate outputs within the processors, obtained for initial processing performed therein (e.g., intermediate outputs 413 and 423), to enable generation of output (from the process 400) indicating how a particular input (to the processor 400) compares relative to at least one other input (to the processor 400).

In an example use scenario, the input 421 may representing a (digital) feedback data corresponding to the feedback measurement of signals corresponding to an original (digital) signal represented as the input 411. Accordingly, the processor 400 may analyze the two inputs (411 and 421) to enable generation of information (e.g., output 431) that may be used in adjusting outputting operations applied to the input 411. For the feedback analysis, the first input processing block 410 and the second input processing block 420 may apply initial processing (e.g., apply a DFT) to the inputs 411 and 421, respectively, resulting in intermediate outputs 413 and 423. These intermediate outputs may then be fed into the comparator 430, for analysis thereby. For example, the comparator 430 may compare the intermediate signals 413 and 423 so as to enable comparing the original samples (i.e., the inputs 411 and 421) in the form of a recommended gain-correction vector—i.e., determine how to input 421 may be adjusted such that it may match the input 411. The result of the comparison performed by the comparator 430 may then be outputted (as output 431), which may then be used—e.g., in controlling use of one of the inputs. For example, in feedback use scenarios, the output 431 of the processor 400 may be used to calculate a conductive transfer function and feedback signal average power, which may enable determining required adjustments to gain applied to the input 411 (when outputting it).

Figure 5:
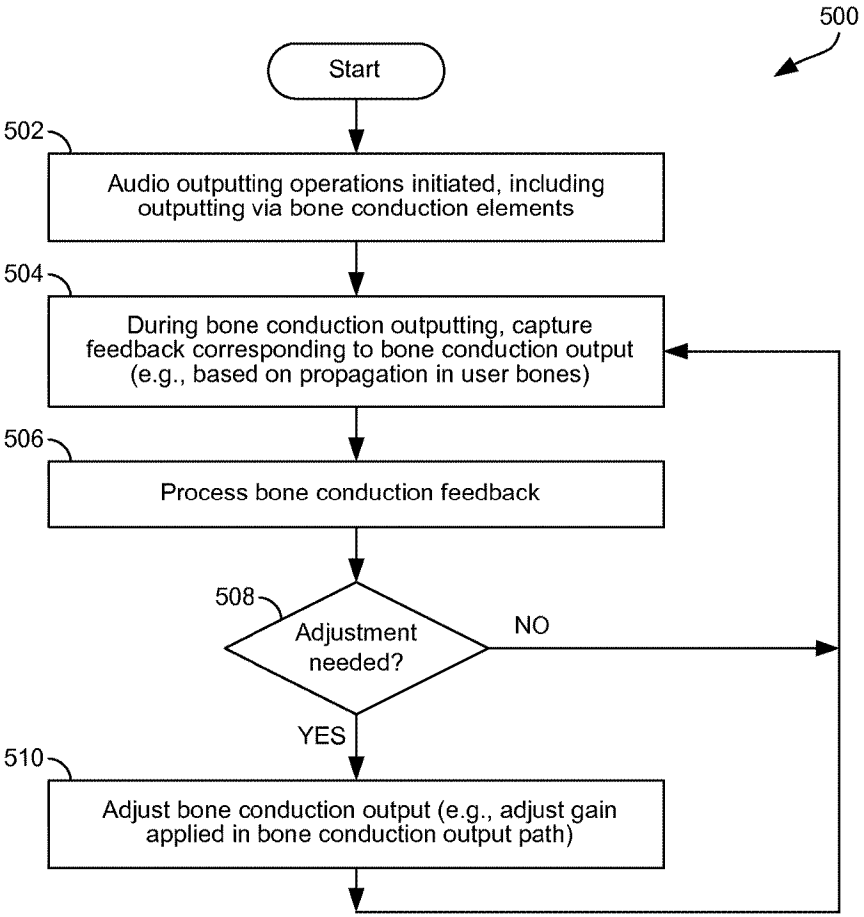
FIG. 5 is a flowchart illustrating an example process for equalization and power control of bone conduction elements.

FIG. 5 is a flowchart illustrating an example process for equalization and power control of bone conduction elements. Referring to FIG. 5, there is shown a flow chart 500, comprising a plurality of example steps, which may executed in a system (e.g., the electronic device 200 of FIG. 3) to provide adaptive control of bone conduction elements.

In step 502, audio outputting operations may be initiated in the system, which may include outputting signals using bone conduction, that is, via bone conduction elements (e.g., the bone conduction element 330).

In step 504, during bone conduction outputting, feedback corresponding to bone conduction output (e.g., based on propagation in a user's bones) may be captured (e.g., via the bone conduction sensor 350).

In step 506, the captured bone conduction feedback may be processed (e.g., via the ADC 360 and/or the processor 370). The processing may also be based on the original (intended) output, such as using copy of the signal intended for output (before outputting via a bone conduction element, or processing it to make it suited for such outputting).

In step 508, it may be determined whether an adjustment may be needed. In instances where no adjustment is deemed necessary, the process may loop back to step 504, to continue monitoring. Otherwise, in instances where it is determined that adjustment is necessary, the process may proceed to step 510.

In step 510, bone conduction outputting related operations or processing may be adjusted, based on the feedback. For example, the adjustment may comprise adjusting gain applied in bone conduction output path (e.g., via the amplifier 320). The process may then loop back to step 504, to continue monitoring (with the monitoring continuing as long as the audio outputting is occurring).

In some implementations, a method may be used for controlling bone conduction in an electronic device (e.g., the electronic device 200). The method may comprise outputting acoustic signals via a bone conduction element (e.g., bone conduction element 240) that is in contact with a user; obtaining, via a bone conduction sensor (e.g., sensory elements of the bone conduction controller 250) that is also in contact with the user, feedback relating to the outputting of the acoustic signals via the bone conduction element; and adaptively controlling (e.g., by the bone conduction controller 250) the outputting of the acoustic signals based on the obtained feedback. The feedback may be processed to determine the adaptive controlling of the outputting of acoustic signals. The processing of the feedback may comprise comparing the feedback with original source signals corresponding the acoustic signals outputted via the via the bone conduction element. The processing of the feedback may be based on preset control criteria (preset levels, or power supply), and/or user settings (e.g., volume control) that affect the acoustic signals or the outputting thereof. The adaptive controlling may comprise adjusting components and/or functions related to the outputting of the acoustic signals. The functions related to the outputting of the acoustic signals may comprise amplification, and the components related to the outputting of the acoustic signals may comprise a drive amplifier used in driving the bone conduction element. In this regard, the adaptive controlling may comprise adjusting gain, frequency response, and/or equalization associated with the amplification and/or the drive amplifier.

In some implementations, a system comprising one or more circuits (e.g., the audio processor 210 and/or the bone conduction controller 250) for use in an electronic device (e.g., the electronic device 200), may be used for controlling bone conduction in the electronic device. The one or more circuits may be operable to output acoustic signals via a bone conduction element (e.g., bone conduction element 240) that is in contact with a user; obtain, via a bone conduction sensor (e.g., sensory elements of the bone conduction controller 250) that is also in contact with the user, feedback relating to the outputting of the acoustic signals via the bone conduction element; and adaptively control (e.g., by the bone conduction controller 250) the outputting of the acoustic signals based on the obtained feedback. The feedback may be processed to determine the adaptive controlling of the outputting of acoustic signals. The processing of the feedback may comprise comparing the feedback with original source signals in the frequency domain, corresponding the acoustic signals outputted via the via the bone conduction element. The processing of the feedback based on preset control criteria (preset levels, or power supply), and/or user settings (e.g., volume control) that affect the acoustic signals or the outputting thereof. The adaptive controlling may comprise adjusting components and/or functions related to the outputting of the acoustic signals. The functions related to the outputting of the acoustic signals may comprise amplification, and the components related to the outputting of the acoustic signals may comprise a drive amplifier used in driving the bone conduction element. In this regard, the adaptive controlling may comprise adjusting gain, frequency response, and/or equalization associated with the amplification and/or the drive amplifier.

In some implementations, a system (e.g., the system 300) may be used for bone conduction and adaptive control thereof. The system may comprise a bone conduction element (e.g., the bond conduction element 330) that is operable to output acoustic signals when in contact with a user (e.g., a user's skull bones 340); a bone conduction sensor (e.g., the bone conduction sensor 350) that is operable to obtain, when in contact with the user (e.g., a user's skull bones 340), feedback relating to the outputting of the acoustic signals via the bone conduction element; a feedback circuit (e.g., the feedback circuit 370) that is operable to process the feedback; and a controller circuit (e.g., the output controller 380) that is operable to adaptively control the outputting of the acoustic signals based on the processing of the feedback. The feedback circuit, when processing the feedback, may be operable to compare the feedback with original source signals corresponding the acoustic signals outputted via the via the bone conduction element. The feedback circuit may be operable to process the feedback based on preset control criteria, and/or user settings that affect the acoustic signals or the outputting thereof. The controller circuit is operable to adaptively control the outputting of the acoustic signals by adjusting components and/or functions related to the outputting of the acoustic signals. The system may further comprise a drive amplifier circuit (e.g., the amplifier 320) that is operable to drive the bone conduction element during the outputting of the acoustic signals. The controller circuit may adjust gain, frequency response, and/or equalization associated with or applicable to a drive amplifier circuit, as part of adaptively controlling the outputting of the acoustic signals.

Other implementations may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for equalization and power control of bone conduction elements.

Accordingly, the present method and/or system may be realized in hardware, software, or a combination of hardware and software. The present method and/or system may be realized in a centralized fashion in at least one computer system, or in a distributed fashion where different elements are spread across several interconnected computer systems. Any kind of computer system or other system adapted for carrying out the methods described herein is suited. A typical combination of hardware and software may be a general-purpose computer system with a computer program that, when being loaded and executed, controls the computer system such that it carries out the methods described herein. Another typical implementation may comprise an application specific integrated circuit or chip.

The present method and/or system may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form. Accordingly, some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. A method, comprising: in an electronic device:

outputting acoustic signals via a bone conduction element in contact with a user at a first location;

obtaining, via a bone conduction sensor that is also in contact with the user at a second location that differs from the first location and senses vibrations introduced in a bone of the user due to the outputting of the acoustic signals via the bone conduction element, feedback relating to the vibrations introduced in the bone of the user due to the outputting of the acoustic signals via the bone conduction element; and adaptively controlling a generation of the acoustic signals based on a spectral analysis of the feedback and power consumed during the generation of the acoustic signals;

wherein the generation of the acoustic signals comprises the outputting of the acoustic signals;

wherein a distance between the first and second locations is a fraction of a distance between a first ear and a second ear of the user.

2. The method of claim 1, comprising processing the feedback to determine the adaptive controlling of the generation of the acoustic signals.

3. The method of claim 2, wherein the processing comprises comparing the feedback with original source signals corresponding to the acoustic signals outputted via the bone conduction element.

4. The method of claim 2, comprising processing the feedback based on preset control criteria, and/or one or more user settings that affect the acoustic signals.

5. The method of claim 1, wherein the adaptive controlling comprises adjusting functions related to the generation of the acoustic signals.

6. The method of claim 5, wherein the functions related to the generation of the acoustic signals comprise amplification applied in driving the bone conduction element.

7. The method of claim 6, comprising adjusting gain, frequency response, and/or equalization associated with the amplification, to effectuate the adaptive controlling.

8. The method according to claim 1 comprising generating an indication that the electronic device is detached from the user and to providing the indication to the user.

9. The method according to claim 1 comprising generating a gain-correction vector which specifies a change of gain to be applied during a generation of the acoustic signals and that is required in each frequency bin out of multiple frequency bins.

10. A system, comprising:

a bone conduction element that is operable to output acoustic signals when the bone conduction element is in contact with a user at a first location;

a bone conduction sensor that is operable to sense vibrations introduced in a bone of the user due to an outputting of the acoustic signals via the bone conduction element, when the bone conduction sensor is in contact with the user at a second location that differs from the first location, and to provide feedback relating to the vibrations introduced in a bone of the user due to the outputting of the acoustic signals via the bone conduction element; and at least one circuit that is operable to process the feedback and to adaptively control a generation of the acoustic signals based on a spectral analysis of the feedback and power consumed during the generation of the acoustic signals;

wherein the generation of the acoustic signals comprises the outputting of the acoustic signals; and wherein a distance between the first and second locations is a fraction of a distance between a first ear and a second ear of the user.

11. The system of claim 10, wherein feedback circuit is operable to, when processing the feedback, compare the feedback with original source signals corresponding the acoustic signals outputted via the bone conduction element.

12. The system of claim 10, wherein feedback circuit is operable to process the feedback based on preset control criteria, and/or one or more user settings that affect the acoustic signals or the outputting thereof.

13. The system of claim 10, wherein the controller circuit is operable to adaptively control the generation of the acoustic signals by adjusting components and/or functions related to the generation of the acoustic signals.

14. The system of claim 10, comprising a drive amplifier circuit that is operable to drive the bone conduction element during the generation of the acoustic signals.

15. The system of claim 14, wherein the controller circuit is operable to adjust gain, frequency response, and/or equalization associated with or applicable to drive amplifier circuit, when adaptively controlling the generation of the acoustic signals.

16. The method according to claim 1, wherein the bone conduction element and the bone conduction sensor are spaced apart from each other and are positioned outside the first and second ears of the user.

17. The method according to claim 1 wherein the adaptively controlling of the generation of the acoustic signals comprises protecting against excessive power consumption of a drive amplifier used in driving the bone conduction element.

18. The system according to claim 10 wherein the at least one circuit comprises a feedback circuit that is operable to process the feedback; and a controller circuit that is operable to adaptively control the generation of the acoustic signals based on the processing of the feedback.

19. The system of claim 10 that is operable to generate an indication that the system is detached from the user and to provide the indication to the user.

20. The system of claim 10 that is operable to generate a gain-correction vector which specifies a change of gain to be applied during a generation of the acoustic signals and that is required in each frequency bin out of multiple frequency bins.

21. The system according to claim 10 wherein the bone conduction element and the bone conduction sensor are spaced apart from each other and are positioned outside the first and second ears of the user.

22. The system according to claim 10, further comprising a drive amplifier used in driving the bone conduction element; and wherein the at least one circuit that is operable to process the feedback and to adaptively control the generation of the acoustic signals based on the processing of the feedback while protecting against excessive drive amplifier power consumption.

* * * * *